US005925506A

United States Patent [19]

Sato et al.

[11] Patent Number: 5,925,506

[45] Date of Patent: Jul. 20, 1999

[54] SILVER HALIDE PHOTOGRAPHIC LIGHT-SENSITIVE MATERIAL

[75] Inventors: Hirokazu Sato, Hino; Shigeo Chino; Masahiro Shibuya, both of Odawara, all of Japan

[73] Assignee: Konica Corporation, Japan

[21] Appl. No.: 08/962,366

[22] Filed: Oct. 31, 1997

[30] Foreign Application Priority Data

Nov. 7, 1996 [JP] Japan ..... 8-295127

[51] Int. Cl.[6] ..... G03C 1/815

[52] U.S. Cl. ..... 430/512; 430/507; 430/518; 430/933

[58] Field of Search ..... 430/933, 507, 430/518, 512

[56] References Cited

U.S. PATENT DOCUMENTS

| | | | |
|---|---|---|---|
| 4,115,124 | 9/1978 | Hamilton et al. | 430/933 |
| 4,526,853 | 7/1985 | Nishijima et al. | 430/933 |
| 4,891,309 | 1/1990 | Uesawa et al. | 430/933 |
| 5,085,978 | 2/1992 | Kajiwara et al. | 430/933 |
| 5,236,804 | 8/1993 | Tanaka et al. | 430/933 |
| 5,395,748 | 3/1995 | Adin et al. | 430/933 |

*Primary Examiner*—Richard L. Schilling
*Attorney, Agent, or Firm*—Jordan B. Bierman; Bierman, Muserlian and Lucas

[57] ABSTRACT

A silver halide photographic light-sensitive material is disclosed. The light-sensitive material comprises a support having on one surface thereof photographic layers including a silver halide emulsion layer, at least one of the photographic layers contains a fluorescent whitening agent, and satisfies the following equation 1:

$$(A/B)<0.03 \qquad \text{Equation 1}$$

wherein A is an intensity of fluorescent light at the maximum fluorescent wavelength generated from the light-sensitive material before processing when the light-sensitive material is irradiated by exciting light of wavelength of 360 nm and B is an intensity of fluorescent light at the maximum fluorescent wavelength thereof generated from the area not exposed to light of the light-sensitive material after processing when the processed light-sensitive material is irradiated by exciting light of wavelength of 400 nm.

11 Claims, No Drawings

SILVER HALIDE PHOTOGRAPHIC LIGHT-SENSITIVE MATERIAL

FIELD OF THE INVENTION

This invention relates to a silver halide photographic light-sensitive material, hereinafter referred to a light-sensitive material, particularly relates to a silver halide photographic light-sensitive material suitable for a printing light-sensitive material to be directly watched which is improved in the whiteness, prevented from the formation of static mark and raised in the pressure resistivity thereof.

BACKGROUND OF THE INVENTION

The whiteness of an unexposed area of a printed image in a light-sensitive material to be directly seen by human eyes, gives an important influence on the quality of the printed image. The increasing in the whiteness of the background of the printed image results increasing in the contrast, in the color purity or chromatics, and in the beautifullness of the picture. Accordingly, various methods for raising the whiteness have been devised. The use of a fluorescent whitening agent has been known as an effective means for raising the whiteness of a printed image obtained from a light-sensitive material. The method for improving the whiteness by the use of the fluorescent whitening agent includes a method by which the fluorescent whitening agent is contained in a processing solution to be used in a color formation processing. Such the method is described in, for example, Japanese Examined Patent Publication (JP) Nos. 46-35240, 49-20975 and 50-25336. However, the above method has such drawbacks that the fluorescent whitening effect is insufficient and the stability of the processing solution is degraded. Recently, the composition of the processing solution used in the processing of the light-sensitive material is further diversified accompanied with the diversification of the processing apparatus and the processing system. Accordingly, a printing light-sensitive material is required, by which a high whiteness can be stably obtained under various processing conditions using a processing solution containing no fluorescent whitening agent.

By another method for using the fluorescent whitening agent, the fluorescent whitening agent is contained in a light-sensitive material. The method is described, for example, in JP Nos. 46-21189, 48-2762, 49-10696, 51-28225 and 52-32254. Although the whiteness of an unexposed area of a print can be raised by this method, the method has a serious drawback such that fogging caused by light of an electrostatic discharge or a static mark is formed in the course of production or processing of the light-sensitive material, for example, at the time of coating constituting layers of the light-sensitive material at a high speed, transporting the light-sensitive material in a color printer, and a tape stuck on the surface of the light-sensitive material is peeled off.

As a means by which the whiteness of a print is raised by adding the fluorescent whitening agent to the light-sensitive material and the above-mentioned static mark can be inhibited, Japanese Patent Publication Open for Public Inspection (JP O.P.I.) Nos. 59-71049 and 59-71050 describe a technique by which a layer containing a compound capable of capturing the fluorescent whitening agent is arranged at a position farther from the support than that of a layer containing the fluorescent whitening agent. However, the static mark preventing effect of such the technique is recently become insufficient because the static mark tend to frequently formed accompanied with a considerable increasing in the transportation speed in the printer for corresponding speedup of the light-sensitive material processing.

Furthermore, speedup of the processing is recently strongly demanded particularly in the field of color paper. Therefore, reduction in the amount of gelatin contained in the light-sensitive material is demanded since it is effective for raising the processing speed by increasing the immersing rate of ingredients of processing solution into the light-sensitive material. However, it has been found that the static mark defect is increased when the gelatin amount in the light-sensitive material is reduced.

For realizing a higher whiteness corresponding to a requirement of higher quality print image, it is effective to increase the amount of the compound capable of capturing the fluorescent whitening agent. However, it is found that, in such the case, the pressure resistivity of the light-sensitive material is lowered and a fog, desensitization and surface defect tend to be formed by applying pressure on the surface of the light-sensitive material in the course of processing or drying. A technology is disclosed in U.S. Pat. No. 4,794,071, JP No. 56-51336 and JP O.P.I. No. 2-168249, by which the fluorescent whitening agent is contained in a support of light-sensitive material. However, such the technique is accompanied with problems that the cost of the support is made higher and the surface uniformity of the support is difficultly maintained. Accordingly, a technology is demanded, by which a high whiteness of the print can be obtained even when a support containing no fluorescent whitening agent is used.

SUMMARY OF THE INVENTION

The object of the invention is to provide a light-sensitive material to be directly seen by human eyes, in which the fluorescent whitening effect is increased to improve the whiteness in an unexposed area of a print, and the static mark defect is effectively inhibited and to provide a light-sensitive material excellent in the pressure resistivity.

The above-mentioned object of the invention is attained by a silver halide photographic light-sensitive material, which comprises a support having on one surface thereof component layers including a silver halide emulsion layer, at least one of the photographic layers contains a fluorescent whitening agent, and satisfies the following equation 1:

$$(A/B)<0.03 \qquad \text{Equation 1}$$

wherein A is an intensity of fluorescent light at the maximum fluorescent wavelength generated from the light-sensitive material before processing when the light-sensitive material is irradiated by exciting light of wavelength of 360 nm and B is an intensity of fluorescent light at the maximum fluorescent wavelength t hereof generated from the area not exposed to light of the light-sensitive material after processing when the processed light-sensitive material is irradiated by exciting light of wavelength of 400 nm.

DETAILED DESCRIPTION OF THE INVENTION

The values of A and B are each easily measured by a spectral fluorescent spectrometer available on the market, by which the wavelength of exciting light and fluorescent light can be respectively scanned. The procedure of the measurement is as follows. A piece of a not-processed light-sensitive material is fixed on a sample holder for reflective sample so that the sample is irradiated by exciting light with an incident angle of 45° and the fluorescent light is detected at an angle of 45°. The intensity of fluorescent light of the sample is measured by varying the wavelength of exciting light to determine the wavelength of the exciting light giving the highest intensity of fluorescent light. The spectral intensity of fluorescent light when the sample is excited by ex citing light at the wavelength giving the maxi mum intensity of fluorescent light is measured to determine the maximum wavelength of fluorescent light. Then the intensity of fluorescent light at the maximum wavelength when the sample is irradiated by exciting light of 360 nm is measured. The intensity of fluorescent light generated by exciting light of 360 nm is referred to A.

Next, a sample of white background prepared by processing the unexposed light-sensitive material sample by the following Processing Procedure 1 using processing solutions containing no fluorescent whitening agent, and the intensity of fluorescent light at the maximum wavelength is measured in the same procedure as above-mentioned except that the wavelength of exciting light is changed to 400 nm. Thus obtained intensity of fluorescent light generated by exciting light of 400 nm is referred to B.

Measuring Condition

| | |
|---|---|
| Light source | 150 W xenon lump |
| Band pass width of exciting light | 1.5 nm |
| Band pass width of fluorescent light detection | 1.5 nm |
| Wavelength scanning rate | 60 nm/min. |
| Response rate | 2 seconds |
| Measuring wavelength range | 300 nm to 500 nm |

The wavelength property of the measuring apparatus such as the spectrometer and photomultiplier is previously compensated using a solution of Rhodamine B for fluorescent analysis as a standard.

Processing Procedure 1

Processing conditions

| | Processing temperature | Time |
|---|---|---|
| Color developing | 38.0 ± 0.3° C. | 45 seconds |
| Bleaching | 35.0 ± 0.5° C. | 45 seconds |
| Washing | 30 to 34° C. | 90 seconds |
| Drying | 60 to 80° C. | 30 seconds |

Composition of Developing Solution

| | |
|---|---|
| Water | 800 ml |
| Triethylenediamine | 2 g |
| Diethylene glycol | 10 g |
| Potassium bromide | 0.01 g |
| Potassium chloride | 3.5 g |
| Potassium sulfite | 0.25 g |
| N-ethyl-N-(β-methanesulfonamidoethyl)-3-methyl-4-aminoaniline sulfonate | 6.0 g |
| N,N-diethylhydroxylamine | 6.8 g |
| Triethanolamine | 10.0 g |
| Sodium diethylenetriaminepentaacetate | 2.0 g |
| Potassium carbonate | 30 g |
| Water to make | 1 liter |

The pH value is adjusted to 10.10

Composition of Bleach-fixing Solution

| | |
|---|---|
| Ferric ammonium diethylenetriamine-pentaacetate dihydrate | 65 g |
| Diethylenetriaminepentaacetic acid | 3 g |

-continued

| | |
|---|---|
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |
| Water to make | 1 liter |

The pH value of the solution is adjusted to 5.0 by potassium carbonate or glacial acetic acid.

In the light-sensitive material of the invention, the value of A/B in the above-mentioned Equation 1 is less than 0.03 for obtaining the effect of the invention. The value of A/B is preferably $0 < A/B < 0.03$, more preferably $0.010 < A/B < 0.025$.

The value of A is a parameter relating to the amount of the fluorescent whitening agent existed in a layer arranged at a position farther from the support than that of the UV absorbent-containing layer which is arranged at the farthest position from the support among UV absorbent-containing layers in a light-sensitive material before processing, and the anti-static mark property of the light-sensitive material is higher when the value of A is lower. The value of B is a parameter relating to the intensity of the fluorescent at the white background of the processed light-sensitive material, and a higher whiteness of the white background is obtained when the value of B is higher. When the amount of the fluorescent whitening agent in a light-sensitive material is increased to raise the whiteness if the white background, the value of A is raised accompanied with increasing of the value of B. Accordingly, the value of A/B of the usual light-sensitive material is not less than 0.03 and degradation of the anti-static mark property caused by increasing the amount of the fluorescent whitening agent cannot be inhibited. It is found by the inventors that both of a high whiteness of the white background and a high anti-static mark property can be obtained by controlling the A/B value to less than 0.03.

The fluorescent whitening agent usable in the invention includes a diaminostilbene fluorescent whitening agent, a benzidine fluorescent whitening agent, an imidazole fluorescent whitening agent, a triazole fluorescent whitening agent, an imidazolone fluorescent whitening agent, a bis(benzoxazolyl)thiophene fluorescent whitening agent, and a bis(benzoxazolyl)stilbene fluorescent whitening agent. A water-soluble fluorescent whitening agent is preferred which has at least one organic acid group having a pKa value of not more than 6.0 or at least one organic base group having a pKb of not less than 7.5 in the molecule thereof. It is more preferred that the whitening agent has at least one organic acid group having a pKa value of not more than 5.0 or at least one organic base group having a pKb value of 4.0 to 7.5 in the molecule thereof. It is more preferable that the fluorescent whitening agent has at least one organic acid group showing a pKa value of not more than 5.0 and at least one organic base group showing a pKb value of 4.0 to 7.5 in the molecule thereof. The pKb value of the organic base group is most preferably 4.0 to 7.0.

The pKa value is an acid dissociation constant which is defined, for example, in Kagaku Binrann (Basic Volume II), p. 1053. The pKb is a base dissociation constant and the definitions of pKa and pKb are also described in JP O.P.I. No. 59-71050, page 3, left upper column.

As the organic acid group of the fluorescent whitening agent, a sulfo group and a carboxyl group are preferred.

The fluorescent whitening is preferably one represented by the following formula. Diaminostilbene type fluorescent whitening agent Diaminostilbene type fluorescent whitening agent Formula I

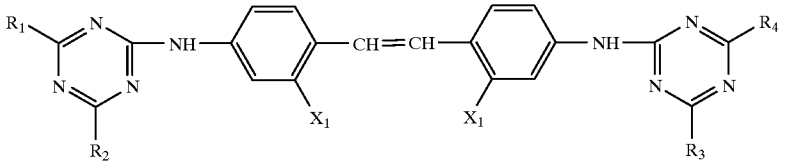

In the formula, $R_1$, $R_2$, $R_3$, and $R_4$ are each a hydrogen atom, a halogen atom, a sulfo group or a salt thereof, a carboxyl group of a salt thereof, an alkylamino group, an arylamino group, a hydroxyl group, an amino group, an alkoxyl group, an aryloxyl group, or a morpholino group. $X_1$ is a sulfo group or a salt thereof, or a carboxyl group or a salt thereof.

In the formula, $X_4$ and $X_5$ are each a hydrogen atom, a sulfo group or a carboxyl group, or a salt of them. $X_6$ is a sulfo group or a carboxyl group, or a salt of them.

Examples of the fluorescent whitening agent usable in the invention are shown below.

Benzidine type fluorescent whitening agent

Formula II

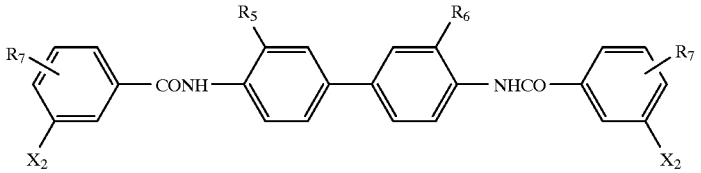

In the formula, $R_5$, $R_6$ and $R_7$ are each a hydrogen atom, a hydroxyl group, an alkyl group or an alkoxyl group. $X_2$ is a sulfo group or a carboxyl group or a salt of them. It is particularly preferable that $R_7$ is a hydroxyl group.

Imidazole type fluorescent whitening agent

Formula III

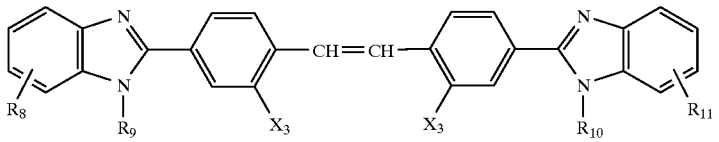

In the formula, $R_8$ and $R_{11}$ are each a hydrogen atom, an alkyl group, an alkoxyl group, or a sulfo group or a salt thereof. $R_9$ and $R_{10}$ are each a hydrogen atom, an alkyl group or a hydroxylalkyl group. $X_3$ is a sulfo group or a carboxyl group, or a salt of them.

Triazole type fluorescent whitening agent

Formula IV

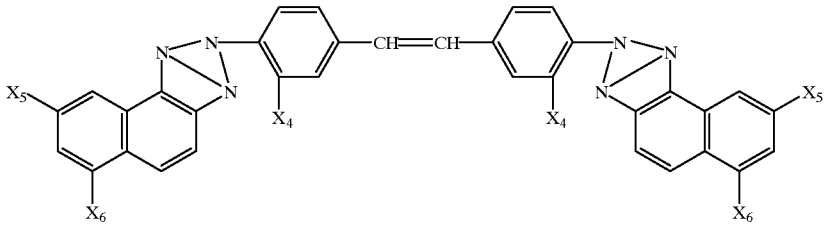

Diaminostilbene type fluorescent whitening agent
FB-1
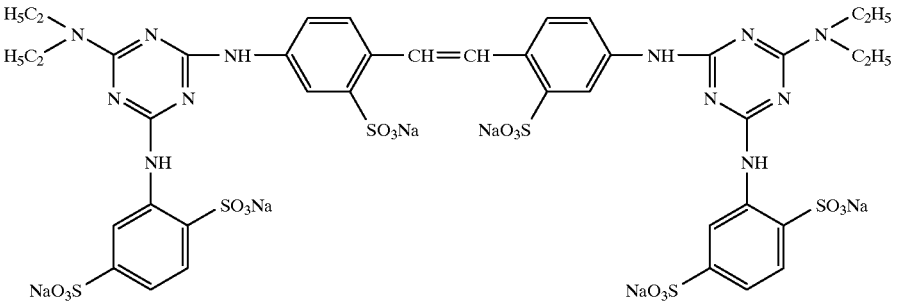
FB-2
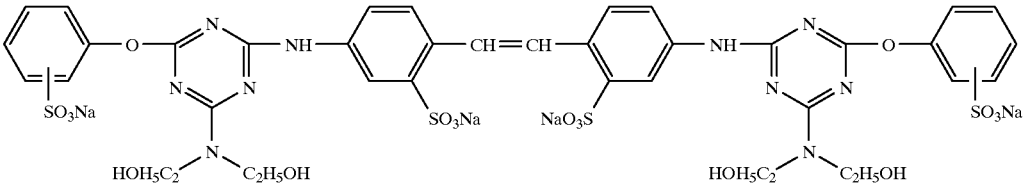
FB-3
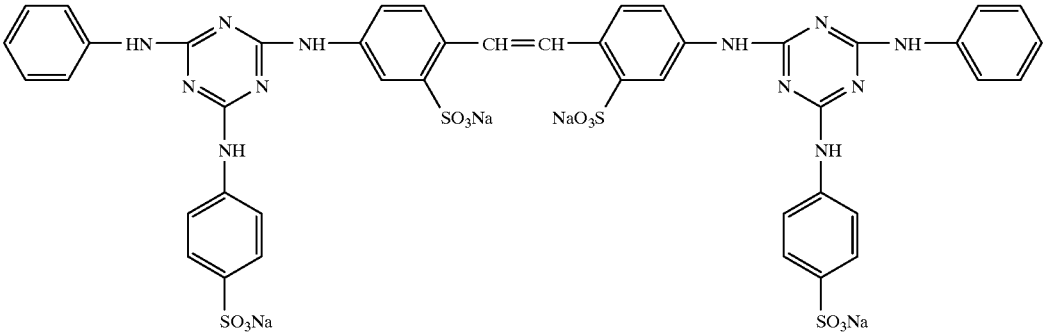
FB-4
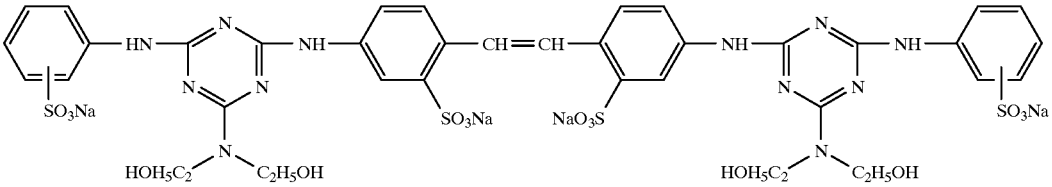
Benzidine type fluorescent whitening agent
FB-5
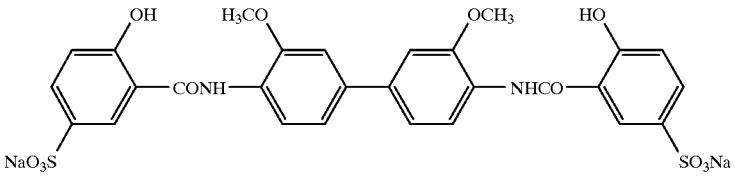
Imidazole type fluorescent whitening agent
FB-6
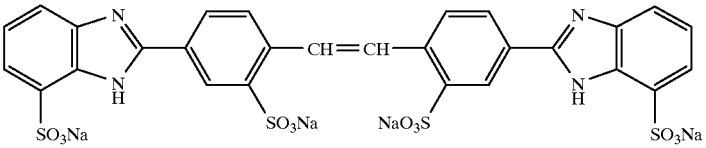

-continued

Triazole type fluorescent whitening agent

FD-7

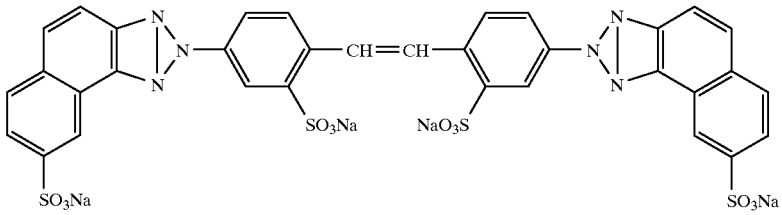

Another type fluorescent whitening agent

FB-8

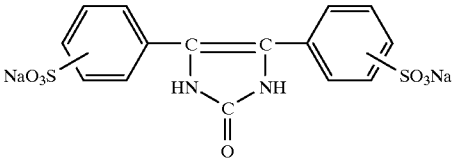

FB-9

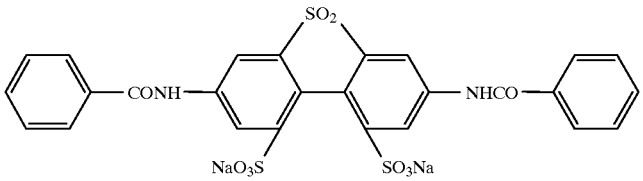

FB-10

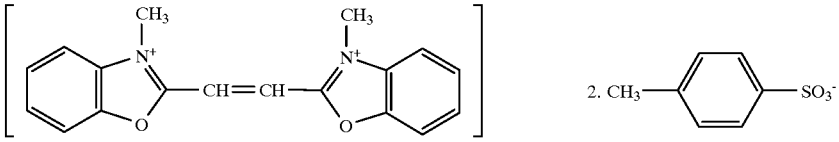

FB-11

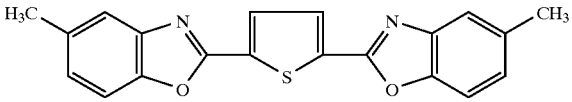

FB-12

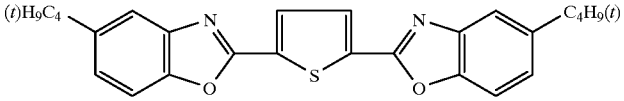

FB-13

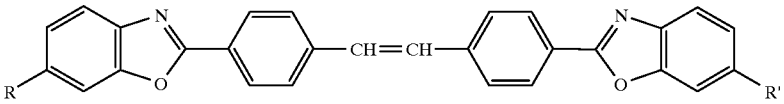

R, R':H or $CH_3$

In a preferable embodiment of the invention, the component layers of the light-sensitive material include a silver halide emulsion layer, a UV-absorbent-containing layer, a fluorescent whitening agent-containing layer and at least two layers each containing a compound capable of capturing the fluorescent whitening agent. In the invention, the layer containing UV absorbent is referred to UV absorbent containing layer-1. When two or more UV absorbent-containing layers are included in the components layers, the UV absorbent-containing layer arranged at the position farthest from the support among the UV absorbent layers is referred to UV absorbent-containing layer-1, and an other UV absorbent-containing layer arranged between the UV absorbent-containing layer-1 and the support is referred to UV absorbent-containing layer-2.

It is preferable for enhancing the effect of the invention that the layer containing the fluorescent whitening agent is arranged between the support and the UV absorbent-containing layer-1. When the UV absorbent-containing layer-1 is singly provided in the light-sensitive material, the layer containing the fluorescent whitening agent is preferably arranged between the UV absorbent-containing layer-1 and the support. The fluorescent whitening agent is preferably contained in any of the layers provided at the position nearer to the support than the position of the UV absorbent-containing layer-1 and the fluorescent whitening agent may be contained in the silver halide emulsion layer . However, it is more preferable that the fluorescent whitening agent is contained in a layer other than the silver halide emulsion layer. For example, when a blue-sensitive emulsion layer, an interlayer, a green-sensitive emulsion layer, an interlayer or a UV absorbent-containing layer, a red-sensitive emulsion layer, a UV absorbent-containing layer, and a protective layer are coated in this order from the support, the fluorescent whitening agent is preferably contained in the interlayer provided between the blue-sensitive emulsion layer and the green-sensitive emulsion layer and/or in the interlayer provided between the green-sensitive emulsion layer and the red-sensitive emulsion layer. The layer containing the fluorescent whitening agent may be the same as the layer containing the compound capable of capturing the fluorescent whitening agent, hereinafter referred to the whitening agent capturing compound. It is preferable for enhancing the effect of the invention that the fluorescent whitening agent is contained in the layer containing the whitening agent capturing compound. It is allowed that the fluorescent whitening agent is contained in the UV absorbent-containing layer-1 or a layer arranged at a position farther than the UV absorbent-containing layer-1, as far as the effect of the invention is not degraded.

In the invention, the coating amount of the fluorescent whitening agent is preferably 0.01 $g/m^2$ to 0.5 $g/m^2$, more preferably 0.02 $g/m^2$ to 0.2 $g/m^2$.

It is preferred for making the value of A/B to less than 0.03 that the photographic layers contain the UV absorbent and the whitening agent capturing compound according to the following constitution; at least one of the UV absorbent-containing layer-1 and a layer arranged at a position farther from the support than the UV absorbent-containing layer-1 contains the whitening agent capturing compound, a layer arranged at a position between the UV absorbent layer-1 and the support contains the fluorescent whitening agent, and a layer arranged at a position between the UV absorbent layer-1 and the support contains the whitening agent capturing compound. It is preferable that the fluorescent whitening agent-containing and the whitening agent capturing compound provided between the UV absorbent layer-1 and the support are contained together with in the same layer.

As the compound capable of capturing the fluorescent whitening agent and enhancing the whitening effect in the invention, various compounds which have been know in the field of photographic material. Specifically effective one is a hydrophilic polymer, for example, polyvinylpyrrolidone, a copolymer having a repeating unit of vinylpyrrolidone in which a monomer constituting a repeating unit of the copolymer together with the vinylpyrrolidone repeating unit includes acrylic acid, methacrylic acid, an amide of acrylic acid or methacrylic acid such as acrylamide, methacrylamide, N,N-dimethylacrylamide, N,N-diethylacrylamide, N-methylol-acrylamide, N-hydroxyethylacrylamide, N-tert-butylacrylamide, N-cyclohexylacrylamide, diacetoneacrylamide, N-(1,1-dimethyl-3 hydroxybutyl)acrylamide, N-(β-morpholino) ethylacrylamide, N-benzylarylamide, N-acryloylmorpholine, N-methaacryloylmorpholine, N-methyl-N'-acryloylpiperadine, N-acryloylpiperidine, N-acryloylpyrrolidine or N-acryloylhexamethyleneimine, an alkylester of a acrylic acid or methacrylic acid such as methyl methacrylate, ethyl acrylate, hydroxyethyl acrylate, propylacrylate, cyclohexyl acrylate, 2-ethylhexyl acrylate, decyl acrylate, β-cyanoethyl acrylate, β-chloroethyl acrylate, 2-ethoxyethyl acrylate or sulfopropyl acrylate, a vinyl ester such as vinyl acetate, vinyl propionate, vinyl butyrate or vinyl lactate, a vinyl ether such as methyl vinyl ether, butyl vinyl ether or oleyl vinyl ether, a vinyl ketone such as methyl vinyl ketone or ethyl vinyl ketone, a styrene such as styrene, methylstyrene, dimethylstyrene, 1,4,6-trimethylstyrene, ethylstyrene, laurylstyrene, chlorostyrene, dichlorostyrene, methoxystyrene, cyanostyrene, dimethylaminostyrene, chloromethylstyrene, vinylbenzoic acid, styrenesulfonic acid or α-methylstyrene, vinyl hetrocyclic compound such as vinylpridine, vinyl-isooxazoline or vinylimidazole, acrylonitrile, vinyl chloride, vinylidene chloride, ethylene, propylene, butadiene, isoplene, chloroplene, maleic anhydride, itaconic anhydride, citraconic anhydride and vinylsulfonic acid. The whitening agent capturing compound further includes poly-N-vinyl-5-methyl-2-oxazolidinone, described in JP No. 48-31842, a polymer of N-vinylamide compound represented by a formula of $CH_2{=}CHNR_1COR_2$ in which $R_1$ is $-CH_3$ or $-C_2H_5$ and $R_2$ is —H, $-CH_3$ or $-C_2H_5$, a hydrophilic polymer containing a cationic reactive nitrogen group, a polymer of N-morpholino-alkylalkenoylamide described in JP No. 44-2522; a copolymer of vinyl alcohol and vinylpyrrolidone described in JP No. 47-20738, a copolymer represented by the following formula described in JP No. 47-49028,

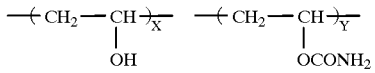

X + Y = 100 to 500, y/(x + y) = 0.05 to 0.25 and a copolymer represented by the following formula described in JP No. 48-38417,

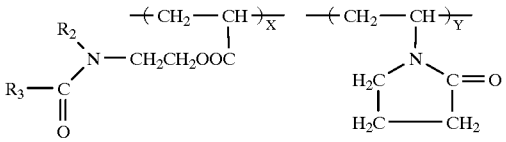

in the above formula, $R_1$ is —H or $-CH_3$, $R_2$ is —H, $-CH_3$, $-C_2H_5$, $-C_3H_7$, or $-C_4H_9$, $R_3$ is —H, $-CH_3$, $-C_2H_5$, $-C_3H_7$, or $-C_4H_9$, and X/Y 59/5 to 20/80. Among the above-mentioned, particularly preferred whitening agent capturing compound is polyvinylpyrrolidone and a copolymer thereof. It is preferable that the content of vinylpyrrolidone in the vinylpyrrolidone copolymer is 30 mole-% or more.

A preferable molecular weight of the above-mentioned hydrophilic copolymer usable in the invention is not less than 1,000, more preferable not less than 10,000, and further preferably 50,000 to 1,000,000 in weight average molecular weight.

In a preferable embodiment of the invention, the whitening agent capturing compound is contained in at least two layers of the light-sensitive material. In such the case, the capturing compound is contained in the UV absorbent-containing layer-1 and/or a layer arranged at a portion farther than the UV absorbent-containing layer-1 and a layer arranged between the UV absorbent-containing layer-1 and the support.

It is preferred that the whitening agent capturing compound-containing layer is the UV absorbent-containing layer-1 and/or a layer arranged at a farther form the support than that of than the portion of the UV absorbent-containing layer-1 is a layer other than the protective layer arranged at the farthest position from the support since the whitening agent capturing compound causes degradation of physical property of the layer surface when the whitening agent capturing compound is contained in the protective layer. It is preferable that the fluorescent whitening agent is contained together with the whitening agent capturing compound in the whitening agent capturing compound-containing layer arranged between the UV absorbent-containing layer-1 and the support.

The amount of the whitening agent capturing compound contained in the UV absorbent-containing layer-1 and/or a layer arranged at a farther form the support than that of than the portion of the UV absorbent-containing layer-1 is preferably 0.005 to 0.1 g/m$^2$ and the amount of the whitening agent capturing compound contained in the layer arranged between the UV absorbent-containing layer-1 and the support is preferably 0.01 to 0.2 g/m$^2$.

The UV absorbent-containing layer may be a single layer or plural layers. When a plurality of the UV absorbent-containing layer is provided, the UV absorbent-containing layer-1 is preferably arranged together with the fluorescent whitening agent-containing layer and the whitening agent capturing compound-containing layer in the above-mentioned order.

As the UV absorbent, a benzotriazole type UV absorbent represented by the following Formula UV is preferably used in the light-sensitive material of the invention.

Formula UV

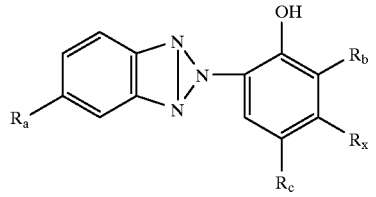

In the formula, $R_a$, $R_b$ and $R_c$ are each a hydrogen atom, a halogen atom, an alkyl group, an aryl group, an alkoxy group, an aryloxy group, an alkenyl group, or a hydroxyl group, and $R_x$ is a hydrogen atom, a halogen atom, an alkoxy group, an aryloxy group, an acylamino group, a sulfonamido group, a ureido group, a urethane group, or an amino group.

Examples of the compound represented by Formula UV are shown below.

| Exemplified No. | $R_a$ | $R_b$ | $R_c$ | $R_x$ |
|---|---|---|---|---|
| UV-1 | —H | —H | —$C_4H_9$(t) | —H |
| UV-2 | —H | —$C_4H_9$(t) | —$C_4H_9$(t) | —H |
| UV-3 | —Cl | —$C_4H_9$(t) | —$CH_3$ | —H |
| UV-4 | —Cl | —$C_4H_9$(t) | —$C_5H_{11}$(t) | —H |
| UV-5 | —H | —$C_5H_{11}$(t) | —$C_4H_9$(t) | —H |
| UV-6 | —$C_4H_9$(t) | —$C_4H_9$(t) | —$C_4H_9$(t) | —H |
| UV-7 | —$C_4H_9$(t) | —$C_4H_9$(sec) | —$C_4H_9$(t) | —H |
| UV-8 | —$C_5H_{11}$(t) | —$C_5H_{11}$(t) | —$C_5H_{11}$(t) | —H |
| UV-9 | —H | —H | —$C_8H_{17}$(t) | —H |
| UV-10 | —H | —$C_4H_9$(t) | —$C_4H_9$(t) | —H |
| UV-11 | —H | —$CH_3$ | —$C_4H_9$(sec) | —H |
| UV-12 | —$OCH_3$ | —$C_5H_{11}$(t) | —$C_5H_{11}$(t) | —H |
| UV-13 | —$CH_3$ | —$C_5H_{11}$(t) | 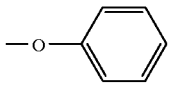 | —H |
| UV-14 | —H | —H | —$C_{12}H_{25}$(t) | —H |
| UV-15 | —$OCH_3$ | —H | —$OC_8H_{17}$(sec) | —H |
| UV-16 | —$C_4H_9$(n) | —$C_4H_9$(sec) | —$C_4H_9$(t) | —H |
| UV-17 | —$C_4H_9$(t) | —$C_4H_9$(sec) | —$C_5H_{11}$(t) | —H |
| UV-18 | —$C_4H_9$(sec) | —$C_4H_9$(t) | —$C_4H_9$(t) | —H |
| UV-19 | —H | —$C_4H_9$(t) | —$C_2H_4COOC_8H_{17}$(n) | —H |
| UV-20 | —H | —$C_8H_{17}$(n) | —$CH_3$ | —H |
| UV-21 | —H | —$C_{12}H_{25}$(n) | —$CH_3$ | —H |
| UV-22 | —Cl | —$C_4H_9$(t) | —$C_2H_4COOC_8H_{17}$(n) | —H |
| UV-23 | —H | —$C_4H_9$(t) | —$C_2H_4COOC_8H_{17}$(n) | —H |
| UV-24 | —H | —$C_4H_9$(sec) | —$C_4H_9$(t) | —H |
| UV-25 | —$OC_4H_9$(t) | —$C_5H_{11}$(t) | —$C_5H_{11}$(t) | —H |
| UV-26 | —H | —H | —H | —$OCH_2$—$CH(C_2H_5)C_4H_9$— |
| UV-27 | —$OCH_3$ | —H | —H | —$OCH_2$—$CH(OH)CH_2OCH_2$—$CH(C_2H_5)C_4H_9$— |

-continued

| Exemplified No. | $R_a$ | $R_b$ | $R_c$ | $R_x$ |
|---|---|---|---|---|
| UV-28 | —Cl | —H | —H | —NHCOOCH$_2$—CH(C$_2$H$_5$)C$_4$H$_9$ |
| UV-29 | —H | —H | —H | —NHSO$_2$CH$_2$—CH(C$_2$H$_5$)C$_4$H$_9$ |

Other than the above-mentioned, the following compounds are preferably usable in the light-sensitive material of the invention; a compound represented by Formula III-3 described in JP O.P.I. No. 1-250944, a compound represented by Formula III described in JP O.P.I. No. 64-66646, Compounds UV-1L to UV-27L described in JP O.P.I. 63-187240, a compound represented by Formula I described in JP O.P.I. No. 4-1633, a compound represented by Formula (I) or (II) described in JP O.P.I. No. 5-165144, and a 2-hydroxyphenyltriazine compound described in JP O.P.I. No. 8-234364.

In the light-sensitive material of the invention, a coating amount of the UV absorbent is preferably 0.1 g/m$^2$ to 5 g/m$^2$, more preferably 0.4 g/m$^2$ to 2 g/m$^2$.

In the invention, an optional silver halide composition such as silver chloride, silver bromide, silver iodide, silver chlorobromide, silver iodobromide and silver chloroiodide, can be used in the silver halide emulsion. In the invention, it is preferable that the silver halide of the emulsion has a silver chloride content of not less than 95 mol-%, and a silver chlorobromide emulsion containing substantially no silver iodide is preferred. A silver halide emulsion having a silver chloride content of not less than 97 mol-%, more preferably 98 to 99.9 mole-%, is preferable from the viewpoint of a suitability for rapid processing and a stability of processing.

A compound of metal of Groups V to XIV of the periodic table can be added to the silver halide emulsion as a preferable embodiment thereof. The application of such the metal compound is effective for improvement in the reciprocity law failure and controlling the sensitometric properties of the light-sensitive material. Moreover, the metal compound is effective to improvement in the variation of the gradation during the accumulation of the emulsion coating liquid.

The metal usable for such the purpose includes manganese, iron, cobalt, nickel, molybdenum, ruthenium, rhodium, as palladium, tungsten, rhenium, osmium, iridium, zinc, mercury, cadmium, gallium, indium and lead. Among them, iron, osmium and ruthenium are preferable.

The compounds of these metal can be added to the silver halide emulsion in a form of salt or complex.

In the case of the metal compound is used in the form complex, a cyanide ion, a thiocyanate ion, a cyanate ion, a chloride ion, a bromide ion, an iodide ion, a nitrate ion, a nitrosyl, a carbonyl and ammonia are preferable as a ligand thereof. Among them, a cyanide ion, a thiocyanate ion, an isothiocyanate ion, a chloride ion, a bromide ion and nitrosyl are preferred.

The metal compound can be contained in the silver halide emulsion by adding the metal compound to the emulsion at any step of before formation of silver halide grains, in the course of silver halide grains and in the course of the physical ripening after formation of silver halide grains. The metal compound can be dissolved together with a halide salt and continuously added to the silver halide emulsion in whole or a part of the course of the formation process of silver halide grains.

The amount of the metal compound is preferably $1\times10^{-9}$ moles to $1\times10^{-2}$ moles, more preferably $1\times10^{-8}$ moles to $5\times10^{-5}$ moles, per mole of silver halide.

Examples of preferably usable metal compound are shown

| | |
|---|---|
| (D-1) | $K_3[Fe(CN)_6]$ |
| (D-2) | $K_4[Fe(CN)_6]$ |
| (D-3) | $K_4[Ru(CN)_6]$ |
| (D-4) | $K_2[Ir(CN)_6]$ |
| (D-5) | $K_2[Fe(CO)_5]$ |
| (D-6) | $Fe(C_5H_5)_2$ |
| (D-7) | $K_4[Os(CN)_6]$ |
| (D-8) | $Cs_2[Os(NO)Cl_5]$ |
| (D-9) | $K_2[Ru(NO)Cl_5]$ |
| (D-10) | $Cs_2[Os(NS)Cl_5]$ |
| (D-11) | $FeCl_2$ |
| (D-12) | $FeCl_3$ |
| (D-13) | $(NH_4)Fe(SO_4)_2$ |
| (D-14) | $K_2[IrCl_6]$ |
| (D-15) | $K_3[IrCl_6]$ |
| (D-16) | $K_2[PtCl_6]$ |
| (D-17) | $K_2[Pt(SCN)_4]$ |
| (D-18) | $K_2[NiCl_4]$ |
| (D-19) | $K_2[PdCl_6]$ |
| (D-20) | $CdCl_2$ |
| (D-21) | $ZnCl_2$ |
| (D-22) | $K_3[Re(CNO)_6]$ |
| (D-23) | $K_4[Fe(CNO)_6]$ |
| (D-24) | $K_4[Ru(CNO)_6]$ |
| (D-25) | $PbCl_2$ |
| (D-26) | $K_3[IrBr_6]$ |
| (D-27) | $K_2[IrBr_6]$ |
| (D-28) | $Ga(NO_3)_3$ |

Silver halide grains having any shape can optionally be used. An example of preferable one is a cubic grain having (100) face as the surfaces thereof. Furthermore, an octahedral grain, a tetradecahedral grain and a dodecahedral grain are also usable, which can be prepared by a method described in U.S. Pat. Nos. 4,183,756 and 4,225,666, JP O.P.I. No. 55-26589, JP 55-42737 and J. Photogr. Sci. 21, 39 (1973). A silver halide grain having twin faces is also usable. It is preferred that the emulsion is comprised of silver halide grains each having the same shape. It is further preferable that two or more kinds of monodisperse emulsion are contained together in the emulsion layer.

Although there is no limitation on the diameter of the silver halide grain, the grain diameter is preferably 0.1 μm to 1.2 μm, more preferably 0.2 μm to 1.0 μm from the view point of suitability to rapid processing and the another photographic property such as sensitivity.

The grain diameter can be determined by a projection area or an approximate value of diameter. When the shape of the grains are substantially uniform, the distribution of grain diameter can be expressed by the diameter or the projection area with a considerable exactitude.

In the invention, the diameter distribution of the silver halide grains is preferably monodisperse having a variation coefficient of not more than 0.22, more preferably not more than 0.15. It is particularly preferable that two or more kinds of monodisperse emulsion each having a variation coefficient of not more than 0.15 are added to the emulsion layer. In the above-mentioned, the variation coefficient is a coefficient representing the width of grain diameter distribution, which is defined by the following equation.

Variation Coefficient=S/R

In the equation, S is the standard deviation of the grain diameter distribution and R is the average grain diameter.

Various apparatus and methods known in the field of the art can be used to produce the silver halide emulsion.

In the invention, the silver halide emulsion may be any one prepared by any method such as a acidic method, a neutral method and ammoniacal method. The silver halide grain can be grown at once or grown after formation of a seed grain. The method for forming the seed grain and that for growing the seed grain may be the same of different.

The procedure for reacting a water-soluble silver salt with a water-soluble halide salt may be any of a normal mixing, a reverse mixing, a double-jet mixing and a combination thereof, and the double-jet mixing method is preferable. As a form of the double-jet mixing method, a pAg controlled double-jet mixing method can also be used, which is described in JP O.P.I. No. 54-48521.

The following apparatus can be used to prepare the silver halide emulsion; an apparatus described in JP O.P.I. Nos. 57-92523 and 57-92524 by which a solution of water-soluble silver salt and a solution of water-soluble halide salt are supplied through a adding device provided in a reaction mother liquid, an apparatus described in German Patent 2921164 by which a solution of water-soluble silver salt and that of a solution of water-soluble halide salt are supplied while continuously varying the concentration of the solution, and an apparatus described in JP O.P.I. No. 56-501776 by which silver halide grains are formed while maintaining the distance between the silver halide grains by taking out the reaction mother liquid and concentrating the liquid by an ultra limitation filtration method.

A silver halide solvent such as thioether can be used according to necessity, and a compound such as a compound having a mercapto group, a nitrogen-containing heterocyclic compound or a sensitizing dye ca also be added at the time of grain formation or after completion of the grain formation.

The silver halide emulsion can be sensitized by a sensitization method using a gold compound and that using a chalcogen sensitizer in combination. It is preferred embodiment of the invention that the emulsion is sensitized by the use of gold compound since the variation of the gradation in the course of standing the coating liquid of the emulsion is inhibited by the use of gold sensitization.

As the gold sensitizer, various gold complexes such as chloroauric acid and gold sulfide. As the ligand of the gold complex, dimethylrhodanine, thiocyanate, mercaptotetrazole, and mercaptotriazole are usable. The using amount of the gold compound is usually $1\times10^{-8}$ moles to $1\times10^{-4}$ moles, preferably $1\times10^{-8}$ moles to $1\times10^{-5}$ moles, per mole of silver halide even though the amount can be varied according to the kind of silver halide emulsion, the kind of the gold compound and the ripening condition.

In the silver halide emulsion, known antifoggants or stabilizing agents can be used for the purpose of preventing fog formed in the course of preparation of the light-sensitive material, inhibiting the variation in the photographic propertiesOO during the storage of the light-sensitive material and preventing fog formed in the course of development. Examples of the compound preferably usable for such the purpose include a compound represented by Formula (II) described in JP O.P.I. No. 2-146036, page 7, lower column, preferably Compound (IIa-1) to (IIa-8), (IIb-1) to (IIb-7) described on page 8 of the same document, 1-(3-methoxyphenyl)-5-mercaptotetrazole and 1-(4-ethoxyphenyl)-5-mercaptotetrazole. These compound can be added, according to the purpose thereof, in the course of silver halide grain formation, in the course of or after completion of the chemical sensitization, or during the coating liquid preparation process. When the chemical sensitization is carried out in the presence of such the compound, the compound is preferably used in an amount of $1\times10^{-5}$ moles to $5\times10^{-4}$ moles per mole of silver halide. When the compound is added after completion of chemical sensitization, an amount of $1\times10^{-6}$ moles to $1\times10^{-2}$ moles per mole of silver is preferable, and an amount of $1\times10^{-5}$ moles to $1\times10^{-3}$ moles per mole of silver is more preferably. When the compound is added to the silver halide emulsion layer in the process of coating liquid preparation, an amount of the compound is preferably $1\times10^{-6}$ moles to $1\times10^{-1}$ moles, more preferably $1\times10^{-5}$ moles to $1\times10^{-2}$ moles, per mole of silver halide. When the compound is added to a layer other than the silver halide emulsion layer, an amount of $1\times10^{-9}$ moles to $1\times10^{-3}$ moles per square meter of the light-sensitive material.

When the light-sensitive material of the invention is a color photographic material, the light-sensitive material has silver halide emulsion layers each respectively containing a yellow color-forming coupler, a magenta color-forming coupler and a cyan color-forming coupler and spectrally sensitized in a specific wavelength region within the range of 400 nm to 900 nm. The silver halide emulsion contains one or more kinds of sensitizing dyes in combination.

In the invention, spectral sensitizing dyes known in the field of the art can be used in the silver halide emulsion. As a blue-sensitive sensitizing dye, Compounds SB-1 to SB-8 described in JP O.P.I. No. 3-251840, page 28, are preferably usable solely of in combination. As a green-sensitive sensitizing dye Compounds GS-1 to GS-5 are preferably usable, which are described on page 27 of the same document. As a red-sensitive sensitizing dye Compounds RS-1 to RS-8 are preferably usable, which are described on page 28 of the same document. When the light sensitive material is imagewise exposed to infrared light using a semiconductor laser, the use of an infrared-sensitive sensitizing dye is necessary. As the infrared sensitive sensitizing dye, Compounds IRS-1 to IRS-11 described in JP O.P.I. No. 4-285950, pages 6 to 8 are preferably usable. It is preferred to use super sensitizers SS-1 to SS-9 described in JP 4-285950, pages 8 to 9, or Compounds S-1 to S-17 described in JP O.P.I. No. 5-66515 together with the above-mentioned infrared-, red-, green- or blue-sensitive sensitizing dye.

The sensitizing dye can be added to the emulsion at an optional time during the silver halide formation to the completion of the chemical sensitization.

The sensitizing dye can be added to the emulsion in a form of solution in a water miscible solvent such as methanol, ethanol, fluorinated alcohol, acetone or dimethylformamide, or water, or in a form of dispersion of solid particles.

As the coupler usable in the light-sensitive material of the invention, a yellow coupler forming a yellow dye having the maximum adsorption wavelength in the range of 400 nm to 500 nm, a magenta coupler forming a magenta dye having the maximum adsorption within the range of 500 nm to 600 nm, and a cyan coupler forming a dye having the maximum adsorption within the rage of 600 nm to 750 nm are typical.

The cyan color-forming coupler preferably usable in the light-sensitive material includes those represented by Formula (C-I) or (C-II) described in JP O.P.I. No. 4-114154, page 5, lower left column. As concrete compounds, CC-1 to CC-9 described on page 5, lower right column, to page 6, lower left column of the above-mentioned document can be described. Furthermore, cyan color-forming couplers C-1 to C-13 described in JP O.P.I. No. 8-254783, pages 13 to 15, can be cited as preferably compounds.

Magenta color-forming couplers preferably usable in the light-sensitive material of the invention include those represented by Formula (M-I) or (M-II) described in JP O.P.I. No. 4-114154, page 4, upper right column. As concrete compounds, MC-1 to MC-11 on page 4, lower left column to page 5, right upper column, of the above-mentioned document can be described. Among the above-mentioned magenta color-forming coupler, those represented by Formula (M-I) described on page 4, upper right column, are preferable, and couplers of Formula (M-I) in which $R_M$ in the formula is a tertiary alkyl group are particularly preferable since they are excellent in the light fastness. Furthermore, magenta color-forming couplers M-1 to M-12 described in JP O.P.I. No. 8-254783, pages 15 to 17, can be cited as preferable compounds.

Yellow color-forming couplers preferably usable in the light-sensitive material of the invention include those represented by Formula (Y-I) described in JP O.P.I. No. 4-114154, page 3, upper right column. As concrete compounds, YC-1 to YC-9 on page 3, lower left column, of the above-mentioned document can be described. Among the above-mentioned yellow color-forming coupler, YC-8 and YC-9 described on page 4, upper left column, are preferable since these couplers form yellow color having preferable tone. Furthermore, yellow color-forming couplers Y-1 to Y-16 described in JP O.P.I. No. 8-254783, pages 18 to 21, can be cited as preferable compounds.

A hydrophobic compound such as a color-forming coupler can be added to an objective hydrophilic colloid layer by the following procedure: the compound is usually dissolved in a high-boiling solvent having a boiling point of not less than 150° C. or a polymer compound insoluble in water and solved in an organic solvent, and, according to necessity, a low-boiling solvent or a water-miscible solvent, and dispersed in a solution of a hydrophilic binder such as gelatin by a dispersing means such as a stirrer, a homogenizer, a colloid mill, a flow-jet mixer or an ultrasonic dispersing device in the presence of a surfactant. Thus obtained dispersion is added to a coating liquid of the hydrophilic colloid layer.

The high-boiling organic solvent usable in the light-sensitive material includes a ester such as phthalate or phosphate, an organic acid amide, a ketone and a hydrocarbon compound. Concrete examples of such the solvent include exemplified compounds A-1 to A-120 described in JP O.P.I. No. 1-196048, pages 4 to 7, II-1 to II-29 described on pages 8 to 9 of the same document, H-1 to H-22 described on pages 14 to 15 of the same document, exemplified compounds S-1 to S-69 described in JP O.P.I. No. 1-209446, pages 3 to 7, and exemplified compound I-1 to I-95 described in JP O.P.I. No. 63-253943, pages 10 to 12.

The Water-insoluble and organic solvent-soluble polymer usable in the light-sensitive material of the invention includes a polymer and copolymer of vinyl compound, a condensation product of a polyvalent alcohol and a polybasic acid, a polyester produced by cycle-opening polymerization method, a polycarbonate resin, a polyurethane resin and a polyamide resin.

Although there is no limitation on the molecular weight of the polymer, the number average molecular weight is preferably not more than 200,000, more preferably 5,000 to 100,000.

Examples of preferably usable polymer are shown below. In the case of copolymer, the weight ratio of the monomers is shown.

| | |
|---|---|
| PO-1 | Poly(N-t-butylacrylamide) |
| PO-2 | N-t-butylacrylamide/methyl methacrylate copolymer (60:40) |
| PO-3 | Polybutyl methacrylate |
| PO-4 | Methyl methacrylate/styrene copolymer (90:10) |
| PO-5 | N-t-butylacrylamide/2-methoxyethyl acrylate copolymer (55:45) |
| PO-6 | ω-metoxyetylene glycol acrylate (adducted amount in molar number = 9)/N-t-butylacrylamide copolymer (25:75) |

Other than the above-mentioned, exemplified compounds P-1 to P-200 described in JP O.P.I. No. 64-537, pages 10 to 15, can be cited.

As a surfactant preferably usable for dispersing a photographic additive or adjusting the surface tension of coating liquid includes one having a hydrophobic group including 8 to 30 carbon atoms and a sulfo group or a salt thereof. A surfactant having a fluorine atom in the alkyl group is also preferably used. The dispersion is usually added to a coating liquid containing the silver halide emulsion. It is preferred that a duration between the preparation and addition of the dispersion to the coating liquid, and a duration between the addition of the dispersion to the coating liquid to coating thereof are short, and the durations are each preferably not longer than 10 hours, more preferable not longer than 3 hours, further preferably not longer than 29 minutes.

A discoloration preventing agent is preferably used together with the above-mentioned couplers to prevent the discoloration of the formed dye image caused by light, heat and humidity. A phenyl ether compound represented by Formula I or II described in JP O.P.I. No. 2-66541, page 3, a phenol compound represented by Formula IIIB described in JP O.P.I. No. 3-174150, an amine compound represented by Formula A described in JP O.P.I. No. 64-90445, and a metal complex represented by Formula XII, XIII, XIV or XV described in JP O.P.I. No. 62-182741 are particularly preferable for the dye formed from the magenta coupler. A compound represented by Formula I' described in JP O.P.I. No. 1-196049 and a compound represented by Formula II described in JP O.P.I. No. 5-11417 are particularly preferable for the dye formed from the yellow coupler or the cyan coupler.

A compound such as Compound d-ll described in JP O.P.I. No. 4-114154, page 9, left lower column, or Compound A'-1 described on page 10 of the same document can be used for shifting the adsorption wavelength of the formed dye.

Gelatin is advantageously usable as a binder in the light-sensitive material of the invention. However, a hydrophilic colloid such as a gelatin derivative, a graftpolymer of gelatin and another high molecular substance, a protein other than gelatin, a sugar derivative, a cellulose derivative, and a synthetic hydrophilic high molecular substance including a polymer and a copolymer, can also be used.

The whole amount of gelatin contained in the light-sensitive material of the invention is preferably less than 8.0 $g/m^2$. Although there is no limitation on the lower limit of the gelatin amount, it is usually preferred that the gelatin amount of not less than 3.0 $g/m^2$ from the viewpoint of the photographic properties such as the fog, sensitivity, gradation and storage ability before exposure. The amount of gelatin is determined in terms of weight of gelatin containing 11.0% of water measured by PAGI method.

It is preferable to use a vinylsulfon type hardener or a chlorotriazine type hardener solely or in combination as the hardener of the binder. A compound described in JP O.P.I. Nos. 51-249054 and 61-245153 is also preferably usable. It is preferred to add a preservative and an anti-mold agent described in JP O.P.I. No. 3-157646 in the colloid layer to prevent breeding a mold and bacterium which give a bad influence on the photographic properties and the storage ability of image. A lubricant and a matting agent described in JP O.P.I. Nos. 6-118543 and 2-73250 are preferably added to the protective layer to improve the surface property of the light-sensitive material before and after processing.

Another additive such as a color fog preventing agent, a plasticizer, an antihalation dye, a polymer latex, a formalin scavenger, a development accelerator, a development moderator, and an antistatic agent can be optionally added to the light-sensitive material. These compounds are described in, for example, JP O.P.I. Nos. 62-215272 and 63-46436.

A support made from any material can be used in the light-sensitive material of the invention. For example, paper coated with polyethylene or polyethylene terephthalate, paper composed of natural pulp or synthetic pulp, a vinyl chloride sheet, a sheet of polypropylene or polyethylene terephthalate which may contains white pigment and baryta paper can be used as the support. Among them, a support composed of a raw paper having a water-proof resin coating on both sides thereof is preferred. As the water-proof resin, polyethylene and polyethylene terephthalate are preferable.

An inorganic and/or organic white pigment are usable in the support, and the inorganic white pigment is preferable. For example, a sulfate of an alkali-earth metal such as barium sulfate, a carbonate of an alkali-earth metal such as calcium carbonate, silica such as finely powdered silica and synthetic silicate, calcium silicate, alumina, hydrated alumina, titanium oxide, zinc oxide, talk, and clay are usable. Preferable white pigment is barium sulfate and titanium oxide.

An amount of the white pigment contained in the water-proof resin layer provided on the support surface is preferably not less than 13%, more preferably not less than 15%, by weight for improving the sharpness of the formed image.

The dispersed degree of the white pigment in the water-proof resin layer of the support can be determined by the method described in JP O.P.I. No. 2-28640. It is preferred that the dispersed degree of the white pigment determined by such the method is not more than 0.20, more preferably not more than 15%, in terms of the variation coefficient described in this document.

It is preferred that the centerline average roughness of the support surface is not more than 0.15 $\mu$m, more preferably not more than 0.12 $\mu$m, since a high glossiness of the surface can be obtained. Furthermore, it is preferred to add a slight amount of a blue- or red-tinting agent such as ultramarine or an oil-soluble dye to the white pigment-containing water-proof resin layer of the support or a hydrophilic colloid layer coated on the support to improve the whiteness of the white background by controlling the balance of the spectral reflection density of the white background of the processed light-sensitive material.

The surface of the support can be subjected to a treatment such as corona discharge, UV irradiation or flame treatment according to necessity. The layers of the light-sensitive material can be coated directly or through a subbing layer on the surface of the support. The subbing layer is composed of one or two layers and is provided to improve the properties of the support surface such as adhesiveness, antistatic property, dimension stability anti-friction property, hardness, and antihalation property.

A thickener can be used to raise the coating ability of coating liquids for coating the layers of the light-sensitive material. An extrusion coating method and a curtain coating method are particularly preferred for coating the layers of the light-sensitive material since two or more layers can be simultaneously coated by these methods.

To form a photographic image on the light-sensitive material, the light-sensitive material can be imagewise exposed by the following method; an image recorded on a negative can be optically focused on the light-sensitive material, the image is converted to digital information and displayed on a cathode lay tube and the displayed image is focused on the light-sensitive material, or the light-sensitive material is scanned by a laser light beam the intensity of which is modulated by the digitized image information.

The invention is preferably applied for a light-sensitive material for forming an image to be directly seen by human eyes, for example, a color paper, a color reversal paper, a light-sensitive material for forming a positive image, a light-sensitive material to display, and a light-sensitive material for a color-proof. It is particularly preferable to apply the invention to a light-sensitive material having a reflective support. The invention can be applied to a light-sensitive material containing a developing agent.

A known aromatic primary amine developing agent is usable for developing the light-sensitive material of the invention. Examples of such the developing agent are described below.

| | |
|---|---|
| CD-1 | N,N-diethyl-p-phenylenediamine |
| CD-2 | 2-amino-5-diethylaminotoluene |
| CD-3 | 2-amino-5-(N-ethyl-N laurylamino)toluene |
| CD-4 | 4-{N-ethyl-N-(β-hydroxyethyl)amino}aniline |
| CD-5 | 2-methyl-4-{N-ethyl-N-(β-hydroxyethyl)-amino}aniline |
| CD-6 | 4-amino-3-methyl-N-ethyl-N-{β-methane-sulfonamide)ethyl}aniline |
| CD-7 | N-(2-amino-5-diethylaminophenylethyl)-methanesulfonamide |
| CD-8 | N,N-dimethyl-p-phenylenediamine |
| CD-9 | 4-amino-3-methyl-N-ethyl-N-methoxyethylaniline |
| CD-10 | 4-amino-3-methyl-N-ethyl-N-(β-ethoxyethyl)-aniline |
| CD-11 | 4-amino-3-methyl-N-ethyl-N-(γ-hydroxypropyl)-aniline |

Although the light-sensitive material can be developed by a developer having any pH without any limitation, the pH value is preferably 9.5 to 13.0, more preferably 9.8 to 12.0, form the viewpoint of rapid processing.

The color development is preferably carried out at a temperature of 35° C. to 70° C. A higher temperature is preferred since a shorter processing time can be realized. However, a temperature not too higher is preferable form the viewpoint of the stability of the processing solution. Accordingly, a temperature of 37° C. to 60° C. is preferable.

Although the color developing is usually carried out for about 3 minutes 30 seconds, a time not more than 45 seconds, more preferably not more than 25 seconds, is preferable in the invention.

A known comment of developer can be added to the developer further to the color developing agent. An alkaline agent having a buffering effect, a chloride ion, a development inhibitor such as benzotriazole, a preservative and a chelating agent are usually used.

The light-sensitive material of the invention may be subjected to a bleaching treatment and a fixing treatment after the development. The bleaching treatment can be carried out with the fixing treatment at the same time. A washing treatment by water is usually applied after the fixing treatment. A stabilizing treatment can be applied in stead of the washing treatment. For the processing of the light-sensitive material, a roller transportation type processing apparatus in which the light-sensitive material is nipped and transported by rollers provided in the processing tank, and an endless-belt type processing apparatus in which the light-sensitive material is fixed on a belt and transported, are usable. Other than the above-mentioned, the following apparatus can be used; an apparatus having a processing chamber having a slit shape in which the light-sensitive material is transported together with the processing solution supplied to the processing chamber, an apparatus in which the processing solution is splayed to the light-sensitive material, an apparatus in which the light sensitive material is contacted with a web immersed with the processing solution, and an apparatus in which a viscous processing solution is applied. When a lot of light-sensitive material is processed, the processing is usually run using an automatic processor. In such the case, it is preferable that a smaller amount of replenisher to be replenished to the processing solution, and the most preferable processing embodiment from the environmental viewpoint is to supply the replenisher in a form of tablet. The method described in Koukai Gihou, Journal of Technical Disclosure No. 94-16935 is most preferable.

EXAMPLES

Example 1

A paper support was prepared by laminating a high-density polyethylene on the both sides of raw paper having a weight of 180 g/m$^2$. In the laminated layer on the side of the paper on which an emulsion layer to be coated, 15 weight-% of surface treated anatase type titanium oxide was dispersed. Thus a reflective support was prepared. The support was treated by corona discharge and a gelatin subbing layer was provided on it. The following layers are coated on the support to prepare Sample 101 of light-sensitive material. The coating liquid was prepared as follows.

First Layer

A solution was prepared by dissolving 22.0 g of yellow coupler Y-1, 3.34 g of dye image stabilizing agent ST-1, 3.34 g of dye image stabilizing agent ST-2, 3.34 g of dye image stabilizing agent ST-5, 0.34 g of stain preventing agent HQ-1, 5.0 g of image stabilizing agent A, 3.33 g of high-boiling solvent DBP, 1.67 g of high-boiling solvent DNP in 60 ml of ethyl acetate. Thus obtained solution was dispersed in 220 ml of a 10% aqueous gelatin solution containing 7 ml of a 20% solution of surfactant SU-1 by an ultrasonic homogenizer to prepare a yellow coupler dispersion. The dispersion was mixed with a blue-sensitive silver halide emulsion prepared by the followings to prepared a coating liquid of the first layer.

Coating liquids of second through seventh layers were each prepared in a manner similar to that in the preparation of the first layer coating liquid so that the coating amount of each components were as described in the followings in which the amount of the compositions are each described in g/m$^2$ and the amount of silver halide emulsion is described in terms of g/m$^2$ of silver.

Hardeners H-1 and H-2 were added, and surfactants SU-2 and SU-3 were added as coating aids to control the surface tension of the coating liquid. Furthermore, F-1 was added to each layers so that the whole amount was become to 0.04 gIm$^2$.

| | |
|---|---|
| 7th Layer: Protective layer | |
| Gelatin | 1.00 |
| DIDP | 0.002 |
| DBP | 0.002 |
| Silicon dioxide | 0.003 |
| 6th Layer: UV absorbing layer | |
| Gelatin | 0.40 |
| AI-1 | 0.01 |
| UV absorbent UV-1 | 0.12 |
| UV absorbent UV-2 | 0.04 |
| UV absorbent UV-3 | 0.16 |
| Stain preventing agent HQ-2 | 0.04 |
| 5th Layer: Red-sensitive layer | |
| Gelatin | 0.30 |
| Red-sensitive silver chlorobromide emulsion Em-R | 0.21 |
| Cyan coupler C-1 | 0.25 |
| Cyan coupler C-2 | 0.08 |
| Dye image stabilizing agent ST-1 | 0.10 |
| Stain preventing agent HQ-1 | 0.004 |
| DBP | 0.10 |
| DOP | 0.20 |
| 4th Layer: UV absorbing layer | |
| Gelatin | 0.94 |
| UV absorbent UV-1 | 0.28 |
| UV absorbent UV-2 | 0.09 |
| UV absorbent UV-3 | 0.38 |
| AI-1 | 0.02 |
| Stain preventing agent HQ-2 | 0.10 |
| 3rd Layer: Green-sensitive layer | |
| Gelatin | 1.30 |
| AI-2 | 0.01 |
| Green-sensitive silver chlorobromide emulsion Em-G | 0.14 |
| Magenta coupler (M-1) | 0.20 |
| Dye image stabilizing agent ST-3 | 0.20 |
| Dye image stabilizing agent ST-4 | 0.17 |
| DOP | 0.50 |
| 2nd Layer: Interlayer | |
| Gelatin | 1.20 |
| AI-3 | 0.01 |
| Stain preventing agent HQ-1 | 0.03 |
| DIDP | 0.04 |
| DBP | 0.02 |
| Fluorescent whitening agent FB-3 | 0.062 |
| 1st layer: Blue-sensitive layer | |
| Gelatin | 1.20 |
| Blue-sensitive silver chlorobromide emulsion Em-B | 0.26 |
| Yellow coupler Y-1 | 0.66 |
| Dye image stabilizing agent ST-1 | 0.10 |
| Dye image stabilizing agent ST-2 | 0.10 |
| Dye image stabilizing agent ST-5 | 0.10 |
| Stain preventing agent HQ-1 | 0.01 |
| Image stabilizing agent A | 0.15 |
| DNP | 0.05 |
| DBP | 0.15 |

Support: Polyethylene-laminated Paper Containing a Little Amount of Colorant

The chemicals used in the above-mentioned receipts are as follows:

SU-1: Sodium salt of di(2-ethylhexyl) sulfosuccinate

SU-2: Sodium tri-i-propylnaphthalenesulfonate

SU-3: Sodium salt of di(2,2,3,3,4,4,5,5-octafluoropentyl) sulfosuccinate

DBP: Dibutyl phthalate

DNP: Dinonyl phthalate

DOP: Dioctyl phthalate

DIDP: Di-i-decyl phthalate

H-1: tetrakis(vinylsulfonylmethyl)methane

H-2: Sodium salt of 2,4-dichloro-6-hydroxy-s-triazine

HQ-1: 2,5-di-t-octylhydroquinone

HQ-2: 2,5-di(1,1-dimethyl-4-hexylcarbonyl) butylhydroquinone

Image stabilizing agent A: p-t-octylphenol

Y-1

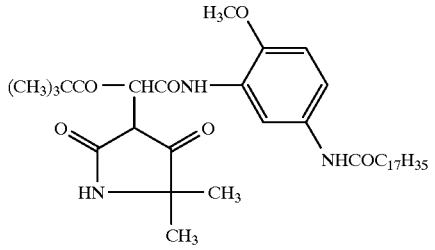

C-1

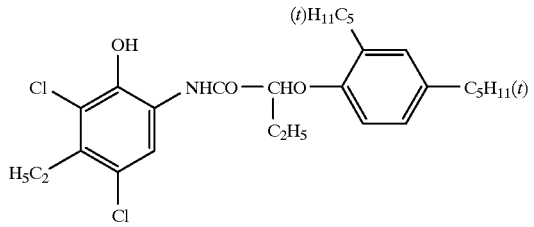

C-2

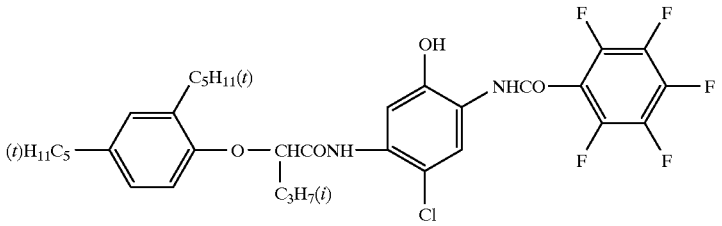

M-1

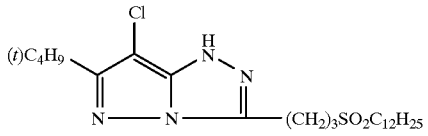

ST-1

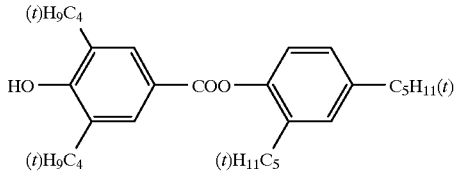

ST-2

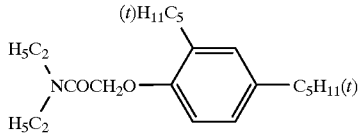

-continued
ST-3
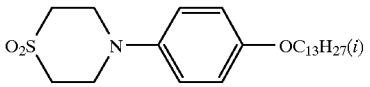
ST-4
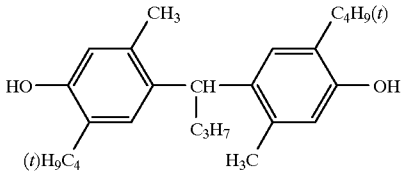
ST-5
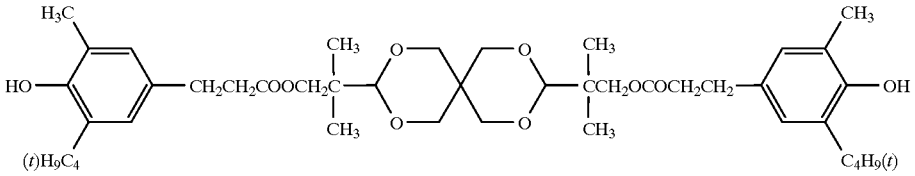
UV-1
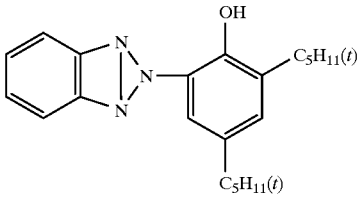
UV-2
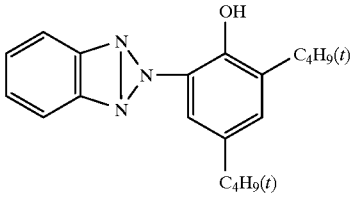
UV-3
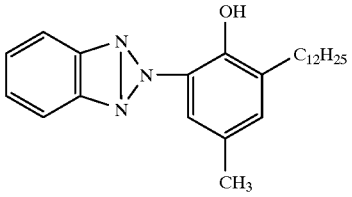
AI-1
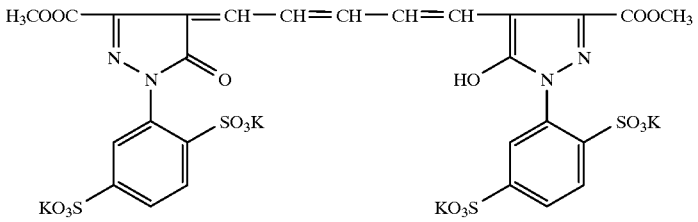

-continued

AI-2

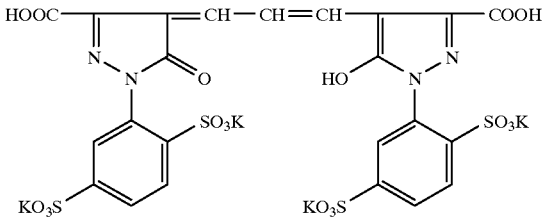

AI-3

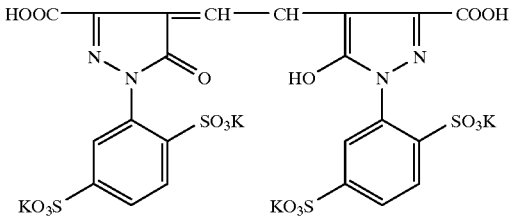

F-1

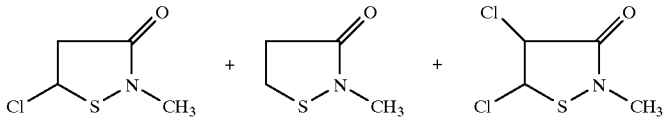

(50 mole-%) (46 mole-%) (4 mole-%)

(Preparation of blue sensitive-silver halide emulsion)

To 1 liter of 2% gelatin solution maintained at 40° C., the following Solution A and Solution B were simultaneously added for 30 minutes while controlling the pAg and pH at 7.3 and 3.0, respectively. Further, Solution C and Solution D were simultaneously added spending 180 minutes while controlling the pAg and pH at 8.0 and 5.5, respectively. The control of the pAg value was carried out by the method described in JP O.P.I. No. 59-45437, and that of the pH value was carried out by using sulfuric acid or sodium hydroxide.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |
| (Solution C) | |
| Sodium chloride | 102.7 g |
| Potassium hexachloroiridate (IV) | $4 \times 10^{-8}$ moles |
| Potassium hexacyanoferrate (II) | $2 \times 10^{-5}$ moles |
| Potassium bromide | 1.0 g |
| Water to make | 600 ml |
| (Solution D) | |
| Silver nitrate | 300 g |
| Water to make | 600 ml |

After completion of the addition, the emulsion was desalted using a 5% solution of Demol, manufactured by Kao-Atlas Co., and a 20% solution of magnesium sulfate, and mixed with a gelatin solution. Thus a monodisperse cubic grain emulsion EMP-1 was obtained, which has an average grain diameter of 0.71 μm, a variation coefficient of grain diameter distribution of 0.07, and a silver chloride content of 99.5 mole-%. On the other hand, a monodisperse cubic grain emulsion EMP-1B was prepared in the same manner as in EMP-1 except that the adding time of Solutions A and B and that of Solutions C and D were changed, which has an average grain diameter of 0.64 μm, a variation coefficient of grain diameter distribution of 0.07, and a silver chloride content of 99.5 mole-%.

EMP-1 was optimally sensitized by chemical sensitization at 60° C. using the following compounds. EMP-1B was also optimally sensitized by the same chemical sensitizer, and sensitized EMP-1 and EMP-1B were mixed in a silver ratio of 1:1 to obtain a blue-sensitive silver halide emulsion Em-B.

| | |
|---|---|
| Sodium thiosulfate | 0.8 mg/mole of AgX |
| Chloroauric acid | 0.5 mg/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |
| Sensitizing dye BS-1 | $4 \times 10^{-4}$ moles/mole of AgX |
| Sensitizing dye BS-2 | $1 \times 10^{-4}$ moles/mole of AgX |

(Preparation of green-sensitive emulsion)

A monodisperse cubic grain emulsion EMP-2 was prepared in the same manner as in EMP-1 except that the adding time of Solutions A and B and that of Solutions C and D were changed, which had an average grain diameter of 0.40 μm, a variation coefficient of grain diameter distribution of 0.08, and a silver chloride content of 99.5 mole-%. Further, EMP-2B was prepared which had an average grain diameter of 0.50 μm, a variation coefficient of grain diameter distribution of 0.08, and a silver chloride content of 99.5 mole-%.

EMP-2 was optimally sensitized by chemical sensitization at 55° C. using the following compounds. EMP-2B was also chemically sensitized optimally, and sensitized EMP-2 and EMP-2B were mixed in a silver ratio of 1:1 to obtain a green-sensitive silver halide emulsion Em-G.

| | |
|---|---|
| Sodium thiosulfate | 1.5 mg/mole of AgX |
| Chloroauric acid | 1.0 mg/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |
| Sensitizing dye GS-1 | $4 \times 10^{-4}$ moles/mole of AgX |

(Preparation of red-sensitive silver halide emulsion)

A monodisperse cubic grain emulsion EMP-3 was prepared in the same manner as in EMP-1 except that the adding time of Solutions A and B and that of Solutions C and D were changed, which had an average grain diameter of 0.40 $\mu$m, a variation coefficient of grain diameter distribution of 0.08, and a silver chloride content of 99.5 mole-%. Further, EMP-3B was prepared which had an average grain diameter of 0.38 $\mu$m, a variation coefficient of grain diameter distribution of 0.08, and a silver chloride content of 99.5 mole-%.

EMP-3 was chemically sensitized optimally at 55° C. using the following compounds. EMP-3B was also chemically sensitized optimally, and sensitized EMP-3 and EMP-3B were mixed in a silver ratio of 1:1 to obtain a green-sensitive silver halide emulsion Em-R.

| | |
|---|---|
| Sodium thiosulfate | 1.8 mg/mole of AgX |
| Chloroauric acid | 2.0 mg/mole of AgX |
| Stabilizer STAB-1 | $3 \times 10^{-4}$ moles/mole of AgX |
| Stabilizer STAB-2 | $3 \times 10^{-4}$ moles/mole of AgX |
| Stabilizer STAB-3 | $3 \times 10^{-4}$ moles/mole of AgX |
| Sensitizing dye RS-1 | $1 \times 10^{-4}$ moles/mole of AgX |
| Sensitizing dye RS-2 | $1 \times 10^{-4}$ moles/mole of AgX |

The chemicals used in the receipts were as follows:

STAB-1:1-(3-acetoamidophenyl)-5-mercaptotetrazole

STAB-2:1-phenyl-5-mercaptotetrazole

STAB-3:1- (4-ethoxyphenyl)-5-mercaptoterazole

AgX: Silver halide.

In the red-sensitive emulsion, SS-1 was added in an amount of $2.0 \times 10^{-3}$ moles per mole of silver halide.

BS-1

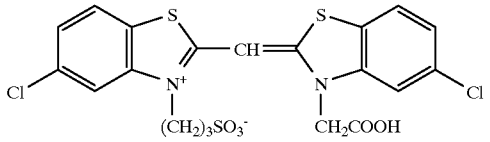

BS-2

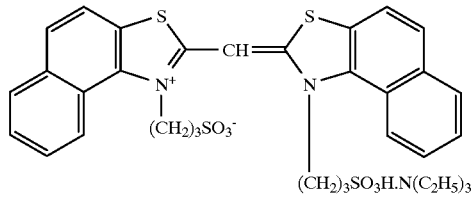

GS-1

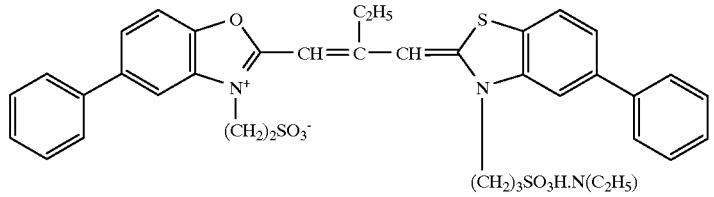

RS-1

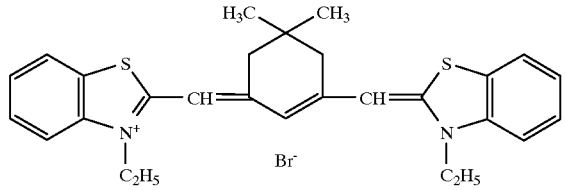

RS-2

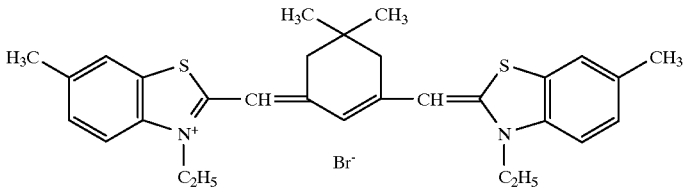

-continued

SS-1

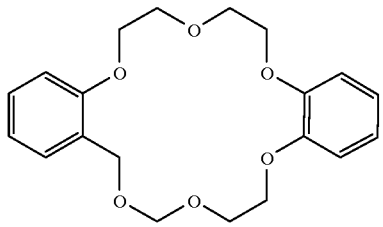

Samples 102 through 113 were prepared in the same manner F- as in Sample 101 except that the fluorescent whitening agent, the whitening agent capturing compound and gelatin were changed as described in Table 1.

The samples were evaluated by the following procedure.

<Determination of A/B>

The intensity of fluorescent light of the sample was measured before and after processing and determined the value of A/B by the foregoing method. Hitachi F-3010 spectral fluorescent meter and Ushio UXL-157 150 W xenon lump were used for the determination.

The processing of the samples was carried out according to the foregoing Processing Procedure 1.

<Antistatic Mark Property>

In a dark room, the light-sensitive material sample was attached three transporting rollers made of polyurethane rubber which were each rotatably installed at each of the vertexes of a triangle holder so that the sample made a loop and the rollers were rotated with a speed of 265 rpm for 3 minutes. Then the sample was processed and the static mark formed on the sample was visually evaluated and classified to five grades. The test was repeated 5 times with respect to one kind of the sample and the grade was determined by the average of the results of the five times of tests.

Grade 1: No static mark was formed.

Grade 2: An area of static marks formed on the sample was account for less than 5% of the whole area of the sample.

Grade 3: An area of static marks formed on the sample was account for 5% to 10% of the whole area of the sample.

Grade 4: An area of static marks formed on the sample was account for more than 10% and less than 30% of the whole area of the sample.

Grade 5: An area of static marks formed on the sample was account for not less than 30% of the whole area of the sample.

<Whiteness of Background>

An unexposed sample was processed by the above mentioned processing and the blue reflective density $D_{440}$ measured by light of 440 nm of the processed sample was measured by Color Analyzer 607 manufactured by Hitachi Co., Ltd.

<Initial Developability>

A sample was exposed to blue light through an optical wedge and processed by the above-mentioned processing, and the maximum density $D_{max}$ of thus obtained image was determined. On the other hand, the sample was exposed to light in the same manner as above and processed by the processing the same as above except that the developing time was shortened by 25 seconds and the maximum density $D_{max}$ of thus obtained image was determined. The initial developability was evaluated according to the value of $D_{max}'/D_{max}$. A value of the ratio of $D_{max}'/D_{max}$ of nearer to 1.0 indicates a higher initial developability.

Test results thus obtained are shown I the following Table 1.

TABLE 1

| Sample No. | Fluorescent whitening agent in 2nd layer (g/m²) | Whitening agent capturing compound PVP* (g/m²) 6th layer | 2nd layer | Whole gelatin amount | A/B | Antistatic mark property | Background whiteness $D_{440}$** | Initial developability $D_{max}'/D_{max}$ |
|---|---|---|---|---|---|---|---|---|
| 101 (c) | FB-3 0.062 | — | — | 7.34 | 0.044 | 4.8 | ±0 | 0.82 |
| 102 (c) | FB-3 0.062 | 0.014 | — | 7.34 | 0.038 | 4.2 | −0.004 | 0.83 |
| 103 (i) | FB-3 0.062 | 0.014 | 0.028 | 7.34 | 0.027 | 2.2 | −0.009 | 0.81 |
| 104 (i) | FB-3 0.062 | 0.014 | 0.056 | 7.34 | 0.020 | 1.0 | −0.015 | 0.82 |
| 105 (i) | FB-3 0.062 | 0.014 | 0.112 | 7.34 | 0.016 | 1.0 | −0.018 | 0.83 |
| 106 (i) | FB-3 0.031 | 0.014 | 0.112 | 7.34 | 0.013 | 1.0 | −0.009 | 0.84 |
| 107 (i) | FB-3 0.015 | 0.014 | 0.112 | 7.34 | 0.008 | 1.0 | −0.006 | 0.80 |
| 108 (c) | FB-3 0.031 | 0.014 | — | 7.34 | 0.034 | 2.6 | −0.002 | 0.84 |
| 109 (c) | FB-3 0.093 | 0.014 | — | 7.34 | 0.055 | 5.0 | −0.007 | 0.80 |
| 110 (i) | FB-3 0.093 | 0.014 | 0.056 | 7.34 | 0.028 | 2.4 | −0.019 | 0.82 |
| 111 (i) | FB-1 0.062 | 0.014 | 0.056 | 7.34 | 0.024 | 1.2 | −0.016 | 0.83 |
| 112 (c) | FB-3 0.062 | 0.014 | — | 8.07 | 0.033 | 3.4 | −0.004 | 0.67 |
| 113 (i) | FB-3 0.062 | 0.014 | 0.028 | 8.07 | 0.026 | 1.8 | −0.008 | 0.68 |

*PVP: Polyvinylpyrrolidone having a weight average molecular weight of approximately 70,000

**In Samples 109 and 110, gelatin amount is increased by 10% in each of the layers thereof compared with that in Sample 101.

***Difference from the $D_{440}$ of Sample 101

(c): Comparative sample (i): Inventive sample.

As is shown in Table 1, Samples 103 to 107, 110, 111 and 113 each according to the invention are excellent in both of the antistatic mark property and the background whiteness. Samples 104 to 106 and 111 each having a A/B value within the range of 0.010 to 0.025 are particularly excellent in the antistatic mark property and the background whiteness.

Example 2

Samples 201 to 209 were prepared in the same manner as in Sample 102 except that the layer in which polyviniylpyrrolidone was added as the whitening agent capturing compound and the adding amount of the polyvinylpyrrolidone were changed as shown in Table 2. In the second layer of each samples contains 0.062 g/m$^2$ of fluorescent whitening agent FB-3.

The samples were evaluated according to the followings.

<Antistatic-mark Property>

The property was evaluated in the same manner as in Example 1.

<Background Whiteness>

The evaluation was carried out in the same manner as in Example 1 except that the samples were processed by the following processing.

<Pressure Resistivity>

The sample was swelled in pure water. A ball-point needle having a diameter of the ball-point of 0.5 mm was vertically stood on the surface of the sample being immersed in water and the sample was moved in a rate of 1 cm/second while continuously increasing a weight loaded on the ball-point needle from 0 to 50 g. Then the sample was dried and exposed to blue light through an optical wedge and processed by the following processing. The minimum weight loaded to the ball-point needle necessary to form a color image by the pressure is determined. A larger value indicates a higher pressure resistivity of the sample.

| Process | Temperature | Time | Replenisher amount |
|---|---|---|---|
| Color development | 38.0 ± 0.3° C. | 45 sec. | 80 ml/m$^2$ |
| Bleach-fixing | 35.0 ± 0.5° C. | 45 sec. | 120 ml/m$^2$ |
| Stabilizing | 30 – 34° C. | 60 sec. | 150 ml/m$^2$ |
| Drying | 60 – 80° C. | 30 sec. | |

Composition of the processing solutions are shown below.

| Color developer | Tank solution | Replenisher |
|---|---|---|
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4 aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriaminepentaacetate | 2.0 g | 2.0 g |
| Fluorescent whitening agent (4,4'-diamino-stilbene-disulfonic acid derivative FB-4) | 2.0 g | 2.5 g |
| Potassium carbonate | 30 g | 30 g |
| Water to make | 1 liter | 1 liter |

Adjust pH values of the tank solution and the replenisher to 10.10 and 10.60, respectively.

Bleach-fixing Solution (to be used as both of the tank solution and the replenisher)

| | |
|---|---|
| Ferric ammonium diethylenetriaminepentaacetate | 65 g |
| Diethylenetriaminepentaacetic acid | 3 g |
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |
| Water to make | 1 liter |

Adjust pH value of the solution to 5.0 by potassium carbonate of alcial acetic acid Stabilizing Solution (to be used as both of the tank solution and the replenisher)

| | |
|---|---|
| o-phenylphenol | 1.0 g |
| 5-chloro-2-methyl-4-isothiazoline-3-one | 0.02 g |
| 2-methyl-4-iosthiazoline-3-one | 0.02 g |
| Diethylene glycol | 1.0 g |
| Fluorescent whitening agent Tipanol SFP | 2.0 g |
| 1-hydroxyethylidene-1,1-disulfonic acid | 1.8 g |
| Bismuth chloride (45% aqueous solution) | 0.65 g |
| Magnesium sulfate heptahydrate | 0.2 g |
| PVP (Polyvinylpyrrolidone) | 1.0 g |
| Ammonia water (25% aqueous solution of ammonium hydroxide) | 2.5 g |
| Tri sodium nitrilotriacetate | 1.5 g |
| Water to make | 1 liter |

Adjust pH value of the solution to 7.5 by sulfuric acid or ammonia water.

Results of the tests are listed in Table 2. In Table 2, (c) and (i) are each represent the comparative sample and the inventive sample, respectively. *: Second layer of each samples contains 0.062 g/m$^2$ of fluorescent whitening agent FB-3.

TABLE 2

| Sample No. | 7th layer Protective layer | 6th layer UV-absorbing layer | 4th layer UV-absorbing layer | 3rd layer Green-sensitive layer | 2nd layer* Inter-layer | A/B | Background whiteness | Anti-static mark | Pressure resistivity |
|---|---|---|---|---|---|---|---|---|---|
| 102 (c) | | PVP 0.014 | | | | 0.038 | ±0 | 4.2 | 43 |
| 201 (c) | PVP 0.014 | | | | | 0.045 | −0.003 | 4.8 | 34 |
| 202 (c) | | | PVP 0.014 | | | 0.032 | +0.007 | 3.6 | 45 |
| 203 (c) | | | | | PVP 0.014 | 0.034 | +0.004 | 3.0 | 44 |

TABLE 2-continued

| Sample No. | 7th layer Protective layer | 6th layer UV-absorbing layer | 4th layer UV-absorbing layer | 3rd layer Green-sensitive layer | 2nd layer* Inter-layer | A/B | Background whiteness | Anti-static mark | Pressure resistivity |
|---|---|---|---|---|---|---|---|---|---|
| 204 (c) | | PVP 0.042 | | | | 0.035 | −0.008 | 4.0 | 14 |
| 205 (c) | | | | | PVP 0.042 | 0.031 | +0.002 | 1.2 | 48 |
| 206 (i) | | PVP 0.014 | PVP 0.028 | | | 0.029 | −0.004 | 2.6 | 42 |
| 207 (i) | | PVP 0.014 | | PVP 0.028 | | 0.028 | −0.004 | 2.4 | 44 |
| 208 (i) | | PVP 0.014 | | | PVP 0.028 | 0.026 | −0.007 | 2.0 | 42 |
| 209 (i) | PVP 0.014 | | | | PVP 0.028 | 0.027 | −0.009 | 2.2 | 33 |

In Table 2, the number under PVP is adding amount of PVP, and (c) and (i) are each shows the the sample is comparative or inventive, respectively.

Background whiteness is described by the difference of $D_{440}$ from that of sample 102.

As is shown in Table 2, Samples 206 to 209 according to the invention are excellent in the background whiteness and the antistatic mark property, and the degradation in the pressure resistivity is also inhibited in these samples. Among the samples of the invention, samples 208 and 209 are particularly excellent in the background whiteness and the antistatic mark property.

Example 3

The samples of Example 2 were processed and evaluated in the same manner as in Example 2 except that the processing was carried out according to Processing CPK-2-J by Konica Corp., using an automatic processor NPS-868J, processing chemicals ECOJET-P. As a result of the tests, it was confirmed that the effects of the invention was obtained as like as in example 2.

What is claimed is:

1. A silver halide photographic light-sensitive material, which comprises a support having on one of the surface thereof component layers, said component layers including:

a silver halide emulsion layer;

a UV absorbent-containing layer-1 which contains a UV absorbent;

a fluorescent whitening agent-containing layer which contains a fluorescent whitening agent, said fluorescent whitening agent-containing layer position between said support and said UV absorbent-containing layer-1;

at least two of said component layers containing a compound capable of capturing the fluorescent whitening agent, wherein one of said two component layers which contains said compound capable of capturing the fluorescent whitening agent is said UV absorbent-containing layer-1 or a layer arranged at a Position farther from the support than the UV absorbent-containing layer-1, and said other of said two component layers which contains said compound capable of capturing the fluorescent whitening agent is arranged between said support and said UV absorbent-containing layer-1; and said silver halide photographic light-sensitive material satisfying the following equation 1:

$$(A/B)<0.03 \qquad \text{equation 1}$$

wherein A is an intensity of fluorescent light at the maximum fluorescent wavelength generated from said light-sensitive material before processing when the light-sensitive material is irradiated by exciting light of wavelength of 360 nm and B is an intensity of fluorescent light at the maximum fluorescent wavelength thereof generated from the area not exposed to light of said light-sensitive material processed by processing solutions each containing no fluorescent whitening agent when the processed light-sensitive material is irradiated by exciting light of wavelength of 400 nm.

2. The light-sensitive material of claim 1 wherein said value of A/B is within the range of from 0.01 to 0.025.

3. The light-sensitive material of claim 1, wherein an amount of gelatin contained in said component layers is not more than 8.0 g/m$^2$ in total.

4. The light-sensitive material of claim 1, wherein said fluorescent whitening agent is a compound represented by the following Formula I, II, III or IV;

Formula I

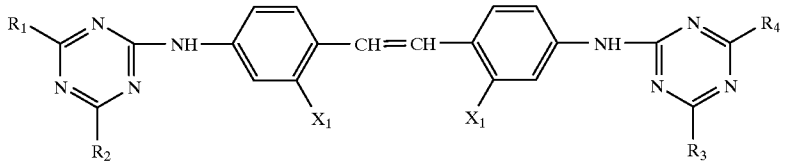

wherein $R_1$, $R_2$, $R_3$, and $R_4$ are each a hydrogen atom, a halogen atom, a sulfo group or a salt thereof, a carboxyl group of a salt thereof, an alkylamino group, an arylamino group, a hydroxyl group, an amino group, an alkoxyl group, an aryloxyl group, or a morpholino group, $X_1$ is a sulfo group or a salt thereof, or a carboxyl group or a salt thereof, Formula II

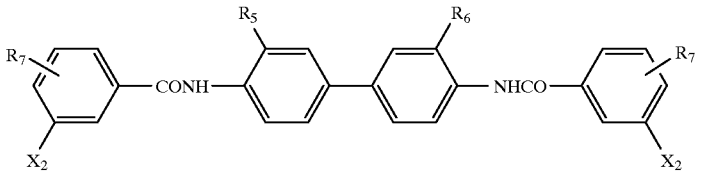

wherein $R_5$, $R_6$ and $R_7$ are each a hydrogen atom, a hydroxyl group, an alkyl group or an alkoxyl group, $X_2$ is a sulfo group or a carboxyl group or a salt of them, Formula III

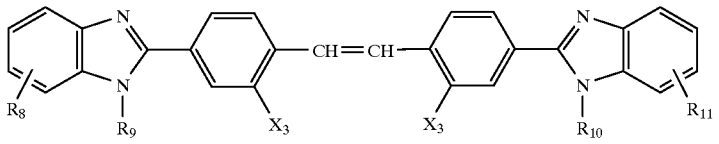

wherein $R_8$ and $R_{11}$ are each an alkyl group, an alkoxyl group, or a sulfo group or a salt thereof, $R_9$ and $R_{10}$ are each a hydrogen atom, an alkyl group or a hydroxylalkyl group, $X_3$ is a sulfo group or a carboxyl group, or a salt of them, Formula IV

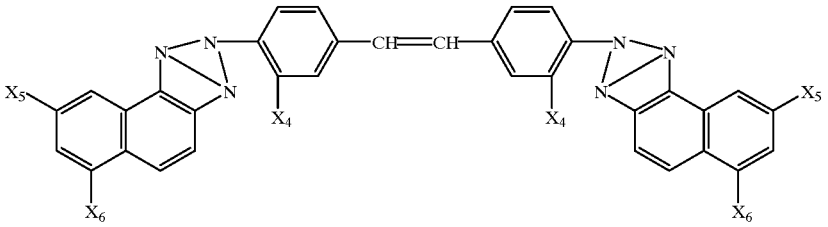

wherein $X_4$ and $X_5$ are each a hydrogen atom, a sulfo group or a carboxyl group, or a salt of them, $X_6$ is a sulfo group or a carboxyl group, or a salt of them.

5. The light-sensitive material of claim 1, wherein the amount of said fluorescent whitening agent is 0.01 to 0.5 $g/m^2$.

6. The light-sensitive material of claim 1, wherein said; a fluorescent whitening agent-containing layer contains both of the fluorescent whitening agent and the compound capable of capturing the fluorescent whitening agent.

7. The light-sensitive material of claim 1, wherein said UV absorbent is a compound represented by the following Formula UV;

Formula UV

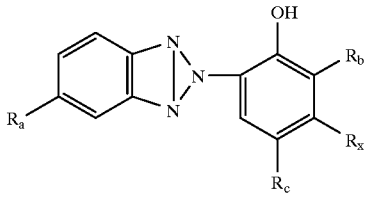

wherein $R_a$, $R_b$ and $R_c$ are each a hydrogen atom, a halogen atom, an alkyl group, an aryl group, an alkoxy group, an aryloxy group, an alkenyl group, or a hydroxyl group, and Ris a hydrogen atom, a halogen atom, an alkoxy group, an aryloxy group, an acylamino group, a sulfonamido group, a ureido group, a urethane group, or an amino group.

8. The light-sensitive material of claim 1, wherein the amount of said UV absorbent contained in said component layers is 0.1 to 5 $g/M^2$.

9. The light-sensitive material of claim 1, wherein said compound capable of capturing the fluorescent whitening agent is polyvinylpyrrolidone or a copolymer containing a repeating unit of vinylpyrrolidone.

10. The light-sensitive material of claim 1, wherein said component layers include a UV absorbent-containing layer-2 other than the UV absorbent-containing layer-1, which contains a UV absorbent and is arranged at a position between the UV absorbent-containing layer-1 and said support.

11. The light-sensitive material of claim 10, wherein the amount of said compound capable of capturing the fluorescent whitening agent in at least one of the UV absorbent-containing layer-1 and the layer arranged at a position farther from said support than the UV absorbent-containing layer-1 is 0.005 to 0.1 $g/m^2$, and the amount of said compound capable of capturing the fluorescent whitening agent contained in said layer arranged at a position between said UV absorbent-containing layer-1 and said support is 0.01 to 0.2 $g/m^2$.

* * * * *